United States Patent [19]

Klaar

[11] 4,249,468

[45] Feb. 10, 1981

[54] MOBILE TRACK TAMPING MACHINE

[75] Inventor: Richard Klaar, Gresten, Austria

[73] Assignee: Franz Plasser Bahnbaumaschinen-Industriegesellschaft m.b.H., Vienna, Austria

[21] Appl. No.: 37,502

[22] Filed: May 10, 1979

[30] Foreign Application Priority Data

Jun. 19, 1978 [AT] Austria ..... 4435/78

[51] Int. Cl.[3] ..... E01B 27/16

[52] U.S. Cl. ..... 104/12

[58] Field of Search ..... 104/12

[56] References Cited

U.S. PATENT DOCUMENTS

| | | | |
|---|---|---|---|
| 3,675,581 | 7/1972 | Plasser et al. | 104/12 |
| 3,717,100 | 2/1973 | Siele et al. | 104/12 |
| 4,130,063 | 12/1978 | Theurer et al. | 104/12 |

FOREIGN PATENT DOCUMENTS

| | | | |
|---|---|---|---|
| 2120231 | 11/1972 | Fed. Rep. of Germany | 104/12 |

*Primary Examiner*—Richard A. Bertsch
*Attorney, Agent, or Firm*—Kurt Kelman

[57] ABSTRACT

A mobile track tamping machine for tamping ballast under the successive ties of a track during the continuous advancement of the machine comprises a tamping tool carrier vertically adjustably mounted on the machine frame and rotatable about a horizontal axis with tamping tools projecting therefrom like spokes for sequential immersion in successive cribs. The tamping tool carrier is rotated in a direction opposite to the working direction of the machine at substantially the same speed as the selected forward speed of the machine by a rotary shaft having two ends rotatably supported on the frame. An assembly of eight pairs of vibratory tamping tools is mounted on an annular support of the carrier, the 16 tamping tools extending in a vertical plane adjacent a rail, radially with respect to the rotary shaft in a rest position and peripherally equidistantly with respect to the annular support. Each tamping tool is mounted on a pivot on the annular support, the pivots extending parallel to the rotary shaft for reciprocating the tamping tools between the rest position and a tamping position. The diameter of the annular support is selected to enable the support to carry 16 equidistantly spaced pivots for the tools, and each tool is connected to a drive for reciprocating it about its pivot.

8 Claims, 4 Drawing Figures

MOBILE TRACK TAMPING MACHINE

The present invention relates to improvements in a mobile track tamping machine mounted for continuous advancement in a working direction at a selected forward speed on a track for tamping ballast under successive ties during the continuous advancement of the machine.

The general type of track machine to which this invention is directed comprises a frame, a tamping tool carrier vertically adjustably mounted on the frame, the carrier being mounted for rotation about a horizontal axis extending transversely to the track and being substantially symmetrical with respect to the axis of rotation, and a drive for rotating the tamping tool carrier in a direction opposite to the working direction of the machine and at substantially the same speed as the selected forward speed thereof. A plurality of tamping tools are mounted on the tamping tool carrier, the tools extending in a vertical plane adjacent at least one of the track rails, substantially radially with respect to the axis of rotation and peripherally equidistantly for sequential immersion in the successive cribs during the continuous advancement of the machine and rotation of the tamping tool carrier.

In concept, the development of this type of track tamping machines is based on the desire to replace the widely practiced track tamping technique which requires stoppage of the tamping machine at each tamping station and intermittent advance of the machine from station to station by a technique which permits the machine to advance continuously during the tamping operation, as successive ties are tamped during this continuous advance. This, of course, increases the speed of the tamping operation and produces a better ratio of actual tamping time to total operating time, reduces the wear on the drive and brakes since they are not subjected to a stop-go operation, and provides more pleasant working conditions for the operating personnel. However, conventional track tamping machines of this type have only partially fulfilled these expectations.

In the track tamping machine disclosed in U.S. Pat. No. 3,675,581, dated July 11, 1972, a substantially wheel-shaped tamping tool carrier is associated with each track rail and six radially extending tamping tools are mounted on each carrier in vertical planes adjacent each lateral side of the associated rail. The tools are vibrated by a central vibrating drive. As the machine advances and the tamping tool carrier is rotated continuously, the tamping jaws enter into the successive cribs like the teeth of a meshing gear and compact the ballast in the cribs by pressing down on it and, in conjunction with the vibratory force exerted by the tamping tools, tamp ballast under the ties at the points of intersection between the ties and the rails which are fastened thereto. The machine operates at relatively high speeds while providing acceptable and substantially uniform ballast supports for the track rails at the points of intersection. However, modern high-speed tracks or tracks subjected to heavy train traffic require a degree of ballast compaction for firm support of the track which cannot be obtained with this machine.

U.S. Pat. No. 3,717,100, dated Feb. 20, 1973, also discloses a wheel-shaped tamping tool carrier for a track tamping machine of this general type. Pairs of tamping tools are mounted on the carrier equidistantly spaced about its periphery and each pair of tools is vertically adjustably mounted on the carrier and is held in a vertically extending position by a special chain drive in all rotary positions of the carrier. The tamping tools of each pair are mounted on a common horizontal pivot to enable the tools to be reciprocated in relation to each other in a pincer-like motion, a drive being provided for each pair of tamping tools for reciprocating the tools as they enter into and are immersed in successive cribs during the rotation of the tamping tool carrier. The construction of such a machine is so difficult that it has not been commercially used. The structure of each pair of tamping tools is complex and correspondingly quite heavy. In addition, the power for the vertical adjustment and reciprocation of each pair of tools must be transmitted through the pivot, causing considerable problems in hydraulic drives in connection with the required fluid-tightness in the region of the pivot. Furthermore, space considerations make it impossible to arrange the pairs of tools, with their drives, so closely around the periphery of the wheel-shaped tamping tool carrier that they can tamp immediately adjacent ties. The distance between adjacent pairs of tamping tools must be selected great enough to enable each pair of tools suspended in a vertical position on the carrier to be accommodated in each angular position of the carrier, including the one in which adjacent pairs of tools are positioned vertically above each other. In other words, the entire structural height of each pair of tools, with its drives, would have to be smaller than the width of the cribs if the pairs of tools were to be spaced closely enough to permit tamping of successive ties. This is, of course, impractical.

German patent application (Offenlegungsschrift) No. 2,120,231, published Nov. 2, 1972, discloses a similar machine in which a plurality of assemblies of two tamping tools are suspended from the wheel-shaped carrier in an arrangement which makes it impractical to space the assemblies so that successive assemblies can tamp successive ties. In this arrangement, too, the tamping tool assemblies are vertically suspended in their rest position.

It is the primary object of the invention to provide a track tamping machine of the type first described hereinabove and having the advantage of continuous rather than intermittent operation while obtaining quantitatively and qualitatively enhanced tamping results heretofore attainable only with the intermittently proceeding tamping technique.

This and other objects are accomplished according to the present invention with an assembly of eight pairs of vibratory tamping tools mounted on the tamping tool carrier. The sixteen tamping tools extend substantially radially with respect to the axis of rotation in a rest position and the tamping tool carrier includes an annular support concentric about the axis of rotation, each of the tamping tools being mounted on a pivot on the annular support. The pivots extend substantially parallel to the axis of rotation for reciprocating the tamping tools in the vertical plane about the pivots thereof between the rest position and a tamping position, the diameter of the annular support being selected to enable the support to carry sixteen equidistantly spaced pivots for the tools. The drive for rotating the tamping tool carrier includes a rotary shaft having two ends rotatable support on the frame and extending in the horizontal axis, and drive means is connected to the tamping tools for reciprocating the tools about the pivots thereof.

Such a structure for the first time makes it possible to use pairs of vibratory and reciprocatory tamping tools found so effective in intermittently advancing tamping machines in a continuous tamping operation. This does not only add to the economic and manufacturing advantage of the machine since it makes use of technically proven tamping tool units, rather than requiring expensive and extensive research and development, but it also imbues the continuous production tamper with the high tamping quality of the more generally used discontinuously operating tampers.

The dimensioning and number of tamping tools are so coordinated in the machine of this invention in relation to the average crib width of the track that the tools of each pair enter adjacent cribs in such a manner that the tie between the cribs is positioned between the tamping tools in the conventional manner, the ballast being tamped under the ties when the tools are squeezed together. The arrangement is such that the tamping tools are properly immersed in succeeding cribs without any vertical displacement of the tools in relation to the tamping tool carrier. Due to the rotation of the tamping tool carrier in a direction opposite to the working direction of the continuously advancing machine and the tamping jaws extending in a circle passing through the ballast in succeeding cribs, successive tamping tools are immersed substantially in the center of these cribs and moved against an adjacent tie during this immersion by the rotation of the carrier, the vibratory and reciprocatory movement being superimposed on this motion by the vibrating and reciprocating drives connected to the tools. As the tamping tool carrier continues to rotate and the machine continues to advance, the tamping jaws move out of each crib after tamping in the same manner in which they have been immersed therein but moving symmetrically in the other direction, i.e. upwards. The immersion depth of all the tamping tools may be advantageously and readily adjusted simply moving the tamping tool carrier up or down to adapt to local operating conditions.

The above and other objects, advantages and features of the invention will become more apparent from the following detailed description of a now preferred embodiment thereof, taken in conjunction with the accompanying schematic drawing wherein FIG. 1 is a simplified side elevational view of a mobile track tamping machine according to this invention;

Figure 1:
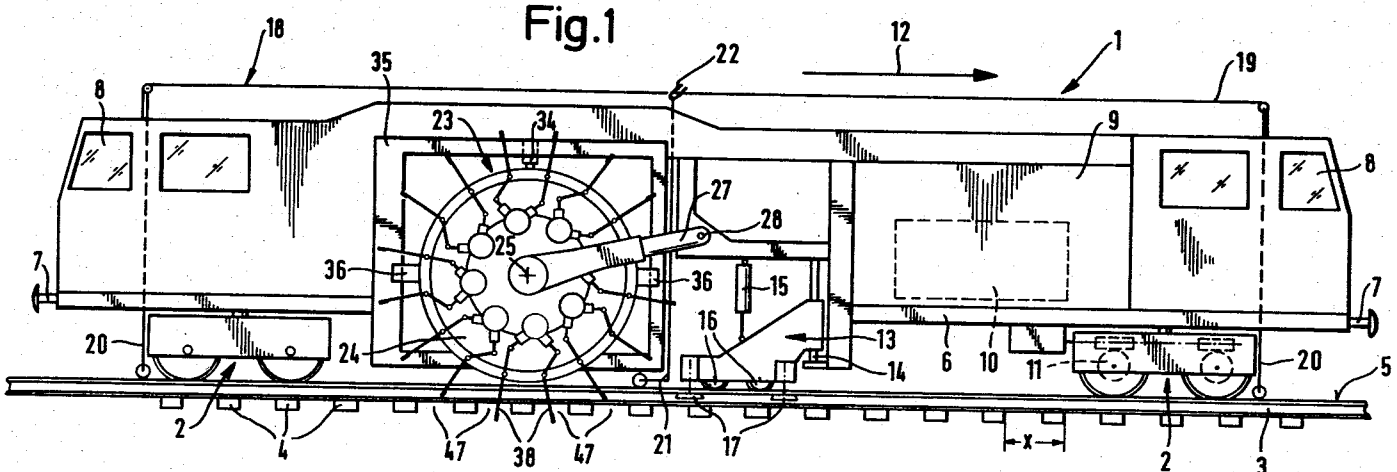
Figure 2:
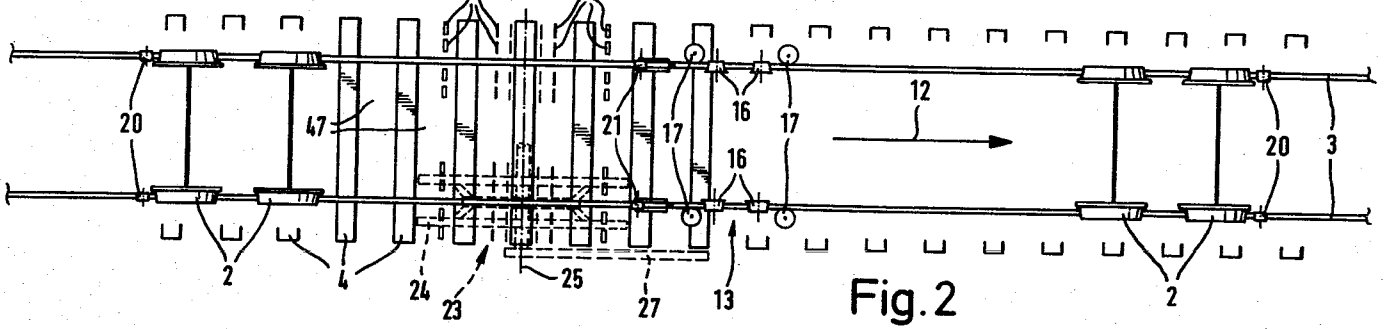
FIG. 2 is a diagram showing the essential features of the machine of FIG. 1 in top view.

Referring now to the drawing and first of FIG. 1, mobile track tamping machine 1 is shown mounted on double-axled swivel trucks 2 for continuous advancement in a working direction indicated by arrow 12 at a selected forward speed on track 5 including two rails 3 fastened to successive ties 4 resting on ballast (not shown) defining cribs 47 therebetween. As will become apparent from the following description, the machine is adapted to tamp ballast under the successive ties during the continuous advancement of machine 1 on track 5.

The machine comprises frame 6 whose respective ends have couplings 7 enabling the machine frame to be attached to adjacent cars of a train, if desired. The frame carries operator's cabs 8 at respective ends thereof and housing 9 encases the power plant for the operation of the machine. The machine is also equipped with drive 11 connected to the power plant and, in the illustrated embodiment, arranged to drive the wheels of forward truck 2 at the selected speed.

The illustrated tamping machine is a combined track leveling and tamping machine which includes generally conventional track leveling unit 13. The leveling unit comprises a carriage mounted on frame 1 for vertical movement along guide posts 14 which are affixed to the machine frame and pass through bores in the carriage to enable the carriage to glide along the posts. The carriage has flanged wheels 16 running on the track rails and carries a pair of gripping rollers 17 which are pivotal into engagement with the outsides of the rails into a track clamping position wherein the rollers subtend the rail head and the rail is held between rollers 17 and flanged wheels 16 which engage the inside of the rail. Lifting cylinder 15 links the carriage of leveling unit 13 to machine frame 6 and is actuated under the control of reference system 18 while the track rails are rigidly held in the clamping position between rollers 17 and flanged wheels 16 to level the track. The illustrated reference system comprises tensioned reference wire 19 extending in a vertical plane defined by a respective wire and associated rail above the rail, the ends of each reference wire being held by element 20 which senses the track grade. Another track grade sensing element 21 is mounted on each rail 3 in the region of leveling unit 13, the upper end of this sensing element being fork-shaped and serving as a switch for controlling lifting cylinder 15 so that it ceases to raise the track when fork-shaped sensing element end 22 contacts reference wire 19 to indicate the desired track level. The present invention is not concerned with the track leveling aspects of the machine and any type of leveling apparatus and reference system may be used in connection with this tamping machine or none may be used if only tamping is desired.

Tamping unit 23 is mounted in the illustrated embodiment immediately rearwardly of leveling unit 13, as seen in the working direction of machine 1 indicated by arrow 12. As shown, machine frame 6 comprises rectangular auxiliary frame 35 and the tamping unit comprises tamping tool carrier 24 vertically adjustably mounted on frame 1. The carrier is mounted for rotation about horizontal axis 25 extending transversely to track 5 and is substantially symmetrical with respect to the axis of rotation.

Figure 3:
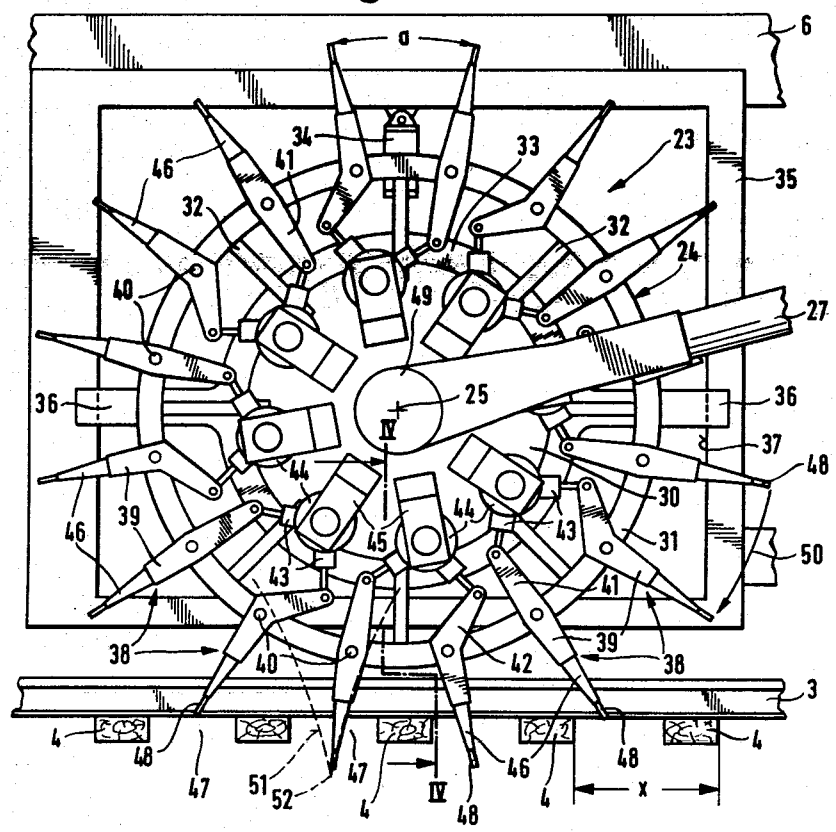
FIG. 3 is an enlarged side elevational view of the tamping unit of the machine of FIG. 1, showing the structural details thereof.

As is shown more clearly in FIG. 3, carrier 24 includes annular support 31 concentric about the axis of rotation. A drive for rotating tamping tool carrier 24 in a direction imparting to the tamping tools a movement opposite to the working direction of the machine and at substantially the same speed as the selected forward speed thereof is shown to include motor 49 and a rotary shaft having two ends 26 rotatably supported on the machine frame and extending in horizontal axis 25. The motor may be a variable-speed hydraulic motor mounted at one shaft end 26, the motor speed being regulated in coordination with the speed of drive 11 to control the rotary speed of the shaft so that the tamping tool carrier rotates in the direction of arrow 50 at the same speed as machine 1 advances in the direction of arrow 17.

In the illustrated and preferred embodiment, telescopingly length-adjustable support arm 27 carries each shaft end 26, the support arms extending in the direction of the machine elongation and means 28 pivotally supporting each support arm on frame 6 for pivoting about an axis extending substantially parallel to the axis of rotation 25. A respective tamping tool carrier 24 is associated with each rail 3 and the illustrated carrier comprises disc-shaped carrier part 30 which extends in vertical plane 29 passing through the associated rail and a pair of the annular supports 31 extending in vertical planes adjacent the associated rails symmetrically with respect to vertical plane 29. The annular supports are rigidly affixed to carrier part 30 by spoke-like connecting members 32 and disc-shaped carrier part 30 is keyed to the rotary shaft for rotation therewith and mounted rotatably in annular bearing 33 which surrounds the carrier part. The annular bearing has two diametrically opposite, radially extending lugs 36 extending horizontally in the direction of the machine elongation and glidably received in vertical guide channels 37 defined in auxiliary frame 35 for vertically adjustably mounting tamping tool carrier 24 of frame 6, hydraulic drive 34 linking annular bearing 33 to auxiliary frame 35 for vertically adjusting the tamping tool carrier on the frame.

The tamping tool carrier structure and mounting provides a relatively rigid connection of the carrier to the machine frame in any desired vertical position and a solid rotary bearing for the carrier at the ends of the rotary shaft. It affords the possibility of mounting the drive for rotating the tamping tool carrier at one or both shaft ends and to transmit the drive power from machine frame 6 through the telescoping support arm for the shaft end. It will be advantageous to mount the power lines for the tamping tool vibrating and reciprocating drive means also within or along support arms 26.

Eight pairs of vibratory tamping tools 38 are mounted on tamping tool carrier 24. The sixteen tamping tools extend in a vertical plane adjacent the associated rail, substantially radially with respect to axis of rotation 25 is a rest position and peripherally equidistantly with respect to annular support 31 for sequential immersion in successive cribs 47 during the continuous advancement of machine 1 and the rotation of tamping tool carrier 24. Pivot 40 carries each tamping tool on the annular support, the pivots extend substantially parallel to axis of rotation 25 for reciprocating tamping tools 38 in the vertical plane about the pivots thereof between the illustrated rest position and a tamping position. Diameter d of annular support 31 is selected to enable the support to carry sixteen equidistantly spaced pivots 40 for tools 38. Drive means 43 is connected to each tamping tool for reciprocating the tools about pivots 40.

Diameter d of annular support 31 preferably is about 1.9 meters, which dimension has been found advantageous for accommodating 8 tamping tool assemblies, with their drives, of a standard type and size used in discontinuously operating track tamping machines without wasting space so that the tamping tools may be mounted without interfering with each other while holding the total diameter of the tamping unit within desired limits. The height of tamping unit 23, that is diameter D of the circle defined by tamping jaws 48 concentrically surrounding annular support 31, preferably does not exceed the height of frame 6, measured from the running faces of track rails 3. With such dimensioning, the tamping machine can operate on all track sections for which the machine is designed. Furthermore this provides a favorable positioning of the point of gravity of the machine, which is of particular advantage when the machine is moved at relatively high speeds from working site to working site and is also important to provide balance for the machine in superelevated curves. Diameter D is advantageously about five times the average width of cribs 47. With such a relationship of the diameter of the circle defined by tamping jaws 48 to the crib width, each tamping jaw makes a periodically repeating cycloid movement in the vertical plane of rotation of the array of tamping tools, the downwardly pointing tamping jaws always entering the ballast in the crib centrally and at a maximum depth. This immersion of tamping jaws 48 into, and lifting out of, the ballast centrally between adjacent ties 4 in a direction deviating only slight from the vertical advantageously provides a relatively wide range of movement for the desired reciprocation of the tamping tools for tamping the ballast under the adjacent ties without any danger of damage to the ties by the reciprocating tools. The wider the path of reciprocation and the deeper the immersion of the tamping jaws in the ballast, the better the ballast compaction and, correspondingly, the higher the quality of tamping. With such dimensions, the machine will, therefore, provide excellent operating results in a continuous tamping operation of high efficiency.

Figure 4:
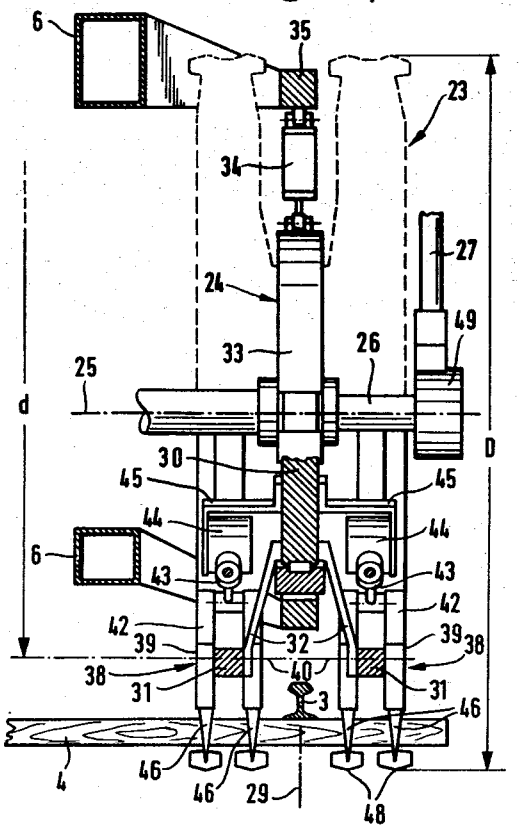
FIG. 4 is a partial section along lines IV—IV of FIG. 3 and showing only the essential structural features of the tamping unit.

As will be seen in FIGS. 3 and 4, common vibrating drive 44 is provided for each pair of tamping tools 38, the tools of each pair being adjacent each other in a circumferential direction and being vibrated by drive 44. The vibrating drives are mounted on brackets 45 mounted on, and projecting laterally from, disc-shaped carrier part 30. Drive means 43 are connected to tamping tools 38 for reciprocating the tools about pivots 40. The illustrated vibrating and reciprocating drives are generally conventional, the vibrating drives being constituted by rotary cranks, i.e. rotary eccenter shafts, and the reciprocating drive means being constituted by hydraulic motors respectively connected to the cranks and a respective tamping tool. This type of tamping tool assembly has been found structurally simple and effective, assuring efficient vibration and reciprocation of the tools for tamping. Reciprocating hydraulic motors 43 are arranged to reciprocate the tamping tools of each pair towards each other and against a tie 4 positioned intermediate the tamping tools of the pair by the rotation of the tamping tool carrier. In this manner, each successive tie is uniformly and effectively tamped by the tamping tools immersed in the two adjacent cribs as the machine advances and the tamping unit is rotated during the tamping operation proceeding without interruption.

As shown in the drawing, tamping tools 38 are two-armed levers comprised of tool holders 39 and replaceably mounted tools 46 with their tamping jaws 48, such tamping tools being entirely conventional. One of the arms of each two-armed tamping tool lever extends from its pivot 40 to hydraulic motor 43 and is linked thereto. This one arm 41 of one of the tamping tool of each pair extends substantially radially with respect to axis of rotation 25 while the one arm 42 of the other tamping tool of each pair encloses an acute angle with a respective tangent of annular support 31 at pivot 40 of the other tamping tool. The tamping tools with the radially extending arm 41 and the obliquely extending arm 42 alternate in a circumferential direction. This arrangement, while assuring a high space economy, assures the widest possible reciprocating range for the tools of each pair while making it possible to use a single vibrating drive for the pair of tools.

Distance a between two circumferentially adjacent tamping jaws 48 is selected to approximate distance x constituted by the average widths of a crib and tie.

In operation, the speed of tamping unit drive 49 is so coordinated with that of drive 11 providing the forward speed of machine 1 that the speed of tamping jaws 48 is the same as that of the machine, the tamping jaws immersed in cribs 47 moving in a direction opposite to that of the machine. Due to this kinematic relationship, as machine 1 advances continuously in the direction of arrow 12 and tamping tool carrier 24 rotates continuously in the direction of arrow 50, each successive tamping jaw 48 moves in cycloidal path 51, which is fixed with respect to track 5, in its vertical rotary plane, the deepest penetration point 52 in the cycloidal path 51 of the tamping jaw occurring substantially centrally between the ties and these points of penetration being periodically repeated in intervals of 16 distances x. To this basic motion of each tamping jaw resulting from the movement of the machine and the tamping tool carrier is added vibratory motion imparted to tamping tools 38 by drives 44 and a reciprocatory motion imparted to the tamping tools of each pair by drives 43 while these tools are immersed in the ballast of adjacent cribs to tamp the intermediate tie. The operation of reciprocating motors 43 may be automated to respond, for example, to the angular position of tamping tools 38 with respect to a vertical plane defined by the intermediate tie and axis of rotation 25. In this manner, the tamping tools of each pair will be reciprocated in a pincer movement to squeeze the ballast under the intermediate tie. This operation is possible because reciprocating motors 43 permit the tamping tools to be reciprocated in, as well as opposite to, the working direction of machine 1. The termination of the reciprocating motion of the tamping tools may be controlled in the conventional manner in response to the degree of compaction of the ballast, the delivery of hydraulic fluid to motors 43 being discontinued automatically in response to the set degree of ballast compaction. Such ballast tamping controls are well known and form no part of the present invention.

While the invention has been described in connection with a now preferred embodiment, structural modifications and variations may occur to those skilled in the art, particularly in connection with the structure and arrangement of the tamping tools and their drives. For example, the tamping tools arranged on the two sides of each rail for effectively tamping ballast under the points of intersection of the ties and rails may be mounted in a common frame or holder and a common reciprocating drive connected to this frame or holder may then connect this drive to a common vibrating drive so that the tools on both sides of the rails are driven in unison by a single drive means. This will further simplify the structure of the tamping tool assemblies and reduce their weight.

What is claimed is:

1. A mobile track tamping machine mounted for continuous advancement in a working direction at a selected forward speed on a track including two rails fastened to successive ties resting on ballast defining cribs therebetween, for tamping ballast under the successive ties during the continuous advancement of the machine, which comprises (a) a frame, (b) a tamping tool carrier vertically adjustably mounted on the frame, the carrier being mounted for rotation about a horizontal axis extending transversely to the track and being substantially symmetrical with respect to the axis of rotation, and the carrier including (1) an annular support concentric about the axis of rotation, (c) a drive for rotating the tamping tool carrier at substantially the same speed as the selected forward speed of the machine, the drive including (1) a rotary shaft having two ends rotatably supported on the frame and extending in the horizontal axis, (d) at least one assembly of eight pairs of vibratory tamping tools mounted on the tamping tool carrier, the sixteen tamping tools extending in a vertical plane adjacent one of the rails, substantially radially with respect to the axis of rotation in a rest position and peripherally equidistantly with respect to the annular support for sequential immersion in the successive cribs during the continuous advancement of the machine and the rotation of the tamping tool carrier, the tamping tools having tamping jaws for immersion in the cribs and the distance between the jaws of adjacent ones of the tools approximating the average combined width of a crib and a tie, and the drive rotating the carrier in a direction imparting to the tamping tools a movement opposite to the working direction of the machine, (e) a pivot on the annular support for each one of the tamping tools, the pivots extending substantially parallel to the axis of rotation for reciprocating the tamping tools in the vertical plane about the pivots thereof between the rest position and a tamping position, the diameter of the annular support being selected to enable the support to carry sixteen equidistantly spaced pivots for the tools, and (f) drive means connected to the tamping tools and arranged for reciprocating the tools of each pair about the pivots thereof towards each other from the rest position onto the tamping position and against a tie positioned intermediate the tamping tools of the pair.

2. The mobile tamping machine of claim 1, wherein the diameter of the annular support is about 1.9 meters.

3. The mobile tamping machine of claim 1, wherein the tamping jaws extend in a circle concentrically surrounding the annular support, the diameter of said circle not exceeding the height of the frame, measured from the running faces of the rails.

4. The mobile tamping machine of claim 3, wherein the diameter of said circle is about five times the average width of the cribs.

5. The mobile tamping machine of claim 1, further comprising a common vibrating drive for each pair of tamping tools, the tools of each pair being adjacent each other in a circumferential direction and being vibrated by the drive, and the reciprocating drive means connecting the tools of each pair to the common vibrating drive therefor.

6. The mobile tamping machine of claim 5, wherein the vibrating drive comprises a rotary crank and the reciprocating drive means comprises hydraulic motors respectively connected to the crank and to a respective one of the tamping tools.

7. The mobile tamping machine of claim 1, wherein the tamping tools are two-armed levers, one of the arms extending from respective ones of the pivots to the drive means and being linked thereto, the one arm of one of the tamping tools of each pair extending substantially radially with respect to the axis of rotation and the one arm of the other tamping tool of each pair enclosing an acute angle with a respective tangent of the annular support at the pivot of the other tamping tool, the tamping tools with the radially extending arm and the obliquely extending arm alternating in a circumferential direction.

8. The mobile tamping machine of claim 1, further comprising vertical guide means vertically adjustably mounting the tamping tool carrier on the frame, a telescopingly length-adjustable support arm for each shaft end, and means for pivotally supporting each support arm on the frame for pivoting about an axis extending substantially parallel to the axis of rotation.

* * * * *